US009777492B2

(12) United States Patent
Freeman et al.

(10) Patent No.: US 9,777,492 B2
(45) Date of Patent: Oct. 3, 2017

(54) CORE FORM DEVICE

(71) Applicants: Michael Freeman, Woburn, MA (US); John Hancock, Merrimack, NH (US)

(72) Inventors: Michael Freeman, Woburn, MA (US); John Hancock, Merrimack, NH (US)

(73) Assignee: Cor-Form, LLC, Meredith, NH (US)

( * ) Notice: Subject to any disclaimer, the term of this patent is extended or adjusted under 35 U.S.C. 154(b) by 0 days.

(21) Appl. No.: 14/599,685

(22) Filed: Jan. 19, 2015

(65) Prior Publication Data

US 2016/0208505 A1 Jul. 21, 2016

(51) Int. Cl.
*E04G 23/02* (2006.01)
*E04G 15/06* (2006.01)

(52) U.S. Cl.
CPC ..... *E04G 23/0203* (2013.01); *E04G 23/0288* (2013.01); *E04G 15/061* (2013.01); *E04G 15/068* (2013.01)

(58) Field of Classification Search
CPC ... E04C 2/52; E04G 23/0203; E04G 23/0285; E04G 23/0288; E04G 15/061; E04G 15/063; E04G 15/065; E04G 15/066; E04G 15/068
See application file for complete search history.

(56) References Cited

U.S. PATENT DOCUMENTS 2,593,456 A * 4/1952 James ..... B28B 7/0064 249/183
2,598,194 A 5/1952 Shippey
2,614,310 A * 10/1952 James ..... E04G 15/063 249/176
2,710,996 A * 6/1955 Pittman ..... E04H 12/04 52/301
3,196,581 A * 7/1965 Castelli ..... E04G 21/22 52/125.3
3,289,374 A * 12/1966 Metz ..... E04G 23/0203 52/514
3,295,285 A 1/1967 Metz
3,325,955 A * 6/1967 Haut ..... E04F 21/02 428/63
3,413,772 A * 12/1968 McCarthy ..... E04G 15/061 248/158
4,075,809 A * 2/1978 Sirkin ..... E04G 23/0203 52/514
4,100,712 A * 7/1978 Hyman ..... E04G 23/0203 428/63
4,201,361 A * 5/1980 Kung ..... E04G 15/065 249/153

(Continued)

FOREIGN PATENT DOCUMENTS

FR 2982297 A1 * 5/2013 ..... E04G 23/0203
GB 2362195 A * 11/2001 ..... B62D 25/24
NO WO 2012005598 A1 * 1/2012 ..... E04G 15/061

OTHER PUBLICATIONS

Kelly, Patrick J., "Practical Guide to 'Free-Energy' Devices", V. 26.2, Aug. 2014, pp. 1, 10-35 through 10-42.

*Primary Examiner* — Rodney Mintz
(74) *Attorney, Agent, or Firm* — Iandiorio Teska & Coleman, LLP

(57) ABSTRACT

A core form device including a circular plate and a plurality of bendable arms extending from the circular plate which when bent about the circular plate form the core form device.

18 Claims, 7 Drawing Sheets

(56) References Cited

U.S. PATENT DOCUMENTS 4,471,594 A * 9/1984 Doyle ..... E04G 23/0203 156/98
4,588,626 A * 5/1986 Cologna ..... B29C 73/14 156/94
4,820,564 A * 4/1989 Cologna ..... B29C 73/14 156/98
4,961,799 A * 10/1990 Cologna ..... B29C 73/14 156/250
5,018,331 A * 5/1991 Forzano ..... E04G 23/0203 52/514
5,033,949 A * 7/1991 Jewett ..... E04G 23/0203 264/30
5,034,254 A * 7/1991 Cologna ..... B29C 73/14 156/307.4
5,299,404 A * 4/1994 Jabro ..... E04G 23/0203 52/514
5,417,519 A * 5/1995 Smuts ..... E21D 5/12 249/152
D367,596 S * 3/1996 Russell ..... D25/199
5,540,013 A * 7/1996 Diamond ..... E04B 1/32 52/646
5,556,688 A 9/1996 Cox
5,778,624 A * 7/1998 Russell ..... E04G 23/0203 52/514
6,044,613 A * 4/2000 Crafts ..... E04G 23/0203 29/402.09
6,070,373 A * 6/2000 Diamond ..... E04B 1/19 52/81.1
6,378,263 B1 * 4/2002 Sobers ..... E04G 23/0203 52/443
7,222,778 B2 * 5/2007 Smith ..... B65D 5/5028 229/116.1
7,665,272 B2 2/2010 Reen
7,730,691 B2 * 6/2010 Patrick ..... E04G 23/0203 52/366
7,827,759 B1 11/2010 Barnes
7,984,595 B2 7/2011 Reen
8,381,474 B2 * 2/2013 Lewis ..... E04G 23/0203 52/514
8,615,949 B2 * 12/2013 Georgievski ..... E04G 23/0203 411/340
8,661,758 B2 3/2014 Longhenry
8,978,341 B2 * 3/2015 Maanum ..... F16K 3/03 52/2.11
9,540,839 B1 * 1/2017 Gross ..... E04H 12/04
2004/0206806 A1 * 10/2004 Smith ..... B65D 5/5028 229/116.1
2005/0204672 A1 * 9/2005 Hansen ..... E04G 23/0203 52/514
2011/0017730 A1 * 1/2011 Marquis-Martin .... H02G 3/121 220/3.9
2013/0112847 A1 * 5/2013 Pantano ..... E04G 13/00 249/13
2013/0232895 A1 * 9/2013 Berset ..... E04G 23/0218 52/223.8
2013/0312354 A1 11/2013 Johnson et al.
2013/0312362 A1 * 11/2013 Maanum ..... F16K 3/03 52/742.13
2014/0035181 A1 * 2/2014 Pantano ..... E04G 13/062 264/35
2014/0174024 A1 6/2014 Longhenry
2016/0208506 A1 * 7/2016 Butler ..... E04G 23/0207

* cited by examiner

CORE FORM DEVICE

FIELD OF THE INVENTION

This invention relates to a core form device.

BACKGROUND OF THE INVENTION

When renovation is conducted on existing structures, the electrical and plumbing conduits which go through the concrete slab or floor are often removed. This may result in core holes being left in the concrete slab or floor.

Conventional techniques to fill core holes include creating a concrete form by securing plates to the bottom of the core holes and then pouring concrete into the constructed form. The problem with such a technique is that the plates must be secured to the bottom of the concrete floor or slab which is located on the floor below. This may require an extensive effort and expense to move and cover furniture and the like if the space below is occupied.

Thus, there is a need to efficiently and effectively fill core holes in a simple and efficient manner.

BRIEF SUMMARY OF THE INVENTION

This invention features a core form device including a circular plate and a plurality of bendable arms extending from the circular plate which when bent about the circular plate form a core form.

In one embodiment, the core form may be configured to be inserted into a core hole in a concrete slab. The concrete slab may include a concrete floor. The one or more of the arms may include an opening for receiving a fastener used to secure the core form device to a concrete slab. The circular plate and the bendable arms may be made of a metal material, an alloy material, or plastic. The plurality of arms may include six arms, five arms, four arms, three arms, or two arms. The diameter of the circular plate may be less than the diameter of the core hole.

This invention also features a method for filling a core hole in a concrete slab. The method includes providing a circular plate including a plurality of bendable arms extending from the circular plate, bending the arms about the circular plate to form a core form for filling the core hole in a concrete slab, inserting the core form into the core hole in the concrete slab, and pouring concrete into the core form to repair the core hole.

In one embodiment, the concrete slab may include a concrete floor. The circular plate may include providing the circular plate with a diameter less than the diameter of the core hole.

This invention also features a method for manufacturing a core form device. The method includes providing a circular plate including a plurality of bendable arms which extend from the circular plate and bending the arms about the circular plate to form a core form for filling core holes in a concrete slab.

In one embodiment, the method may include providing an opening in one or more of the arms for receiving a fastener. The circular plate may include providing the circular plate with a diameter less than the diameter of the core hole.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
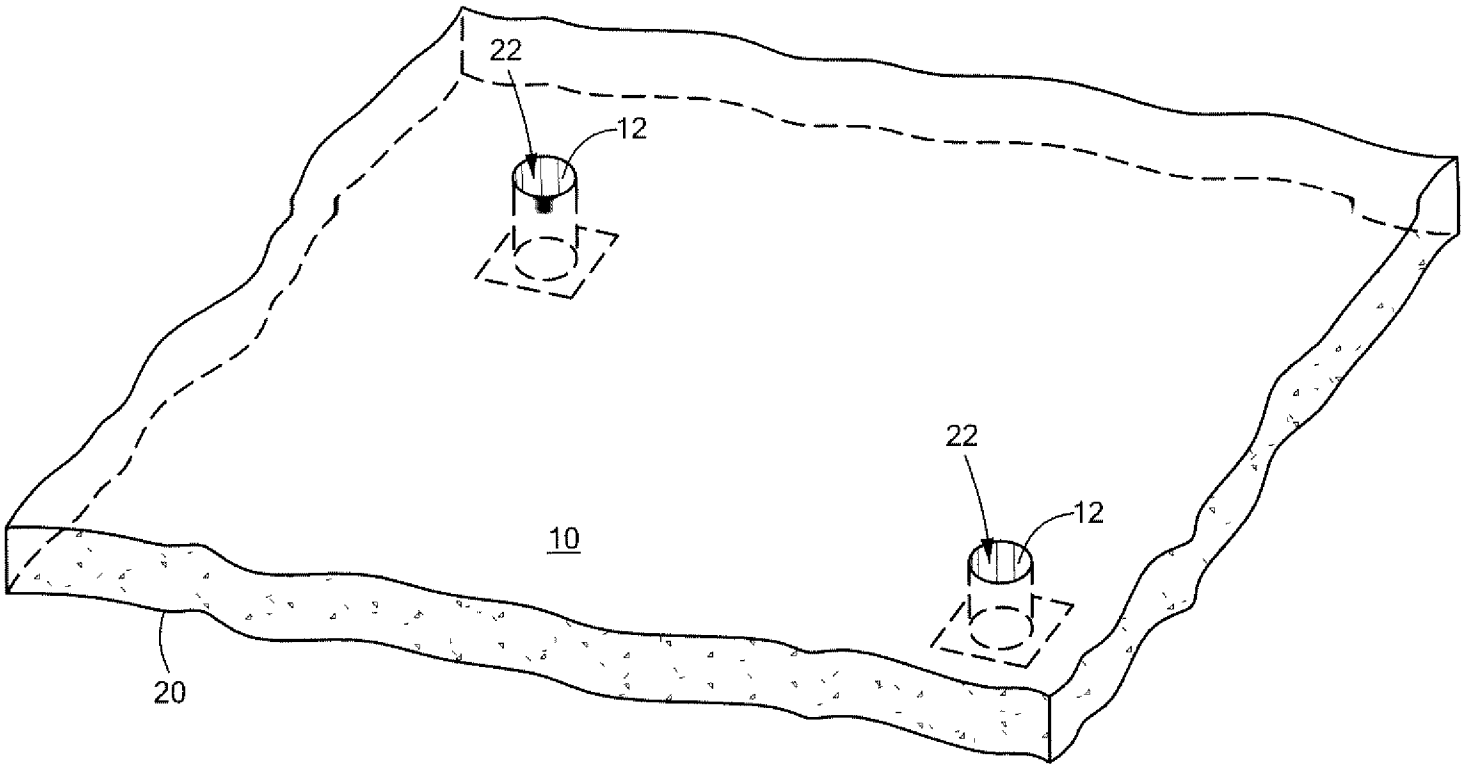
FIG. 1 (PRIOR ART)
FIG. 1 is a three-dimensional view of a typical concrete slab or floor with core holes being repaired using conventional techniques.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

As discussed in the Background section, when renovation is conducted on existing structures, the electrical and plumbing conduits which go through the concrete floor are often removed. The result is core holes may be left in the concrete slab or floor. For example, FIG. 1 shows an example of concrete slab or floor 10 wherein core holes 12 and 14 are created during a renovation process.

Conventional techniques to fill core holes 12 and 14 may include creating concrete forms by securing plates 16, 18 to bottom of core holes 12 and 14, respectively, on bottom surface 20 of floor or slab 10. Concrete is then poured into the constructed forms, as indicated by arrows 22 to repair the core holes.

The problem with such a technique is that plates 16 and 18 must be attached to bottom surface 20 of floor or slab 10 which is located on the floor below. This requires an extensive effort if the space occupied below floor or slab 10 is occupied.

Figure 2:
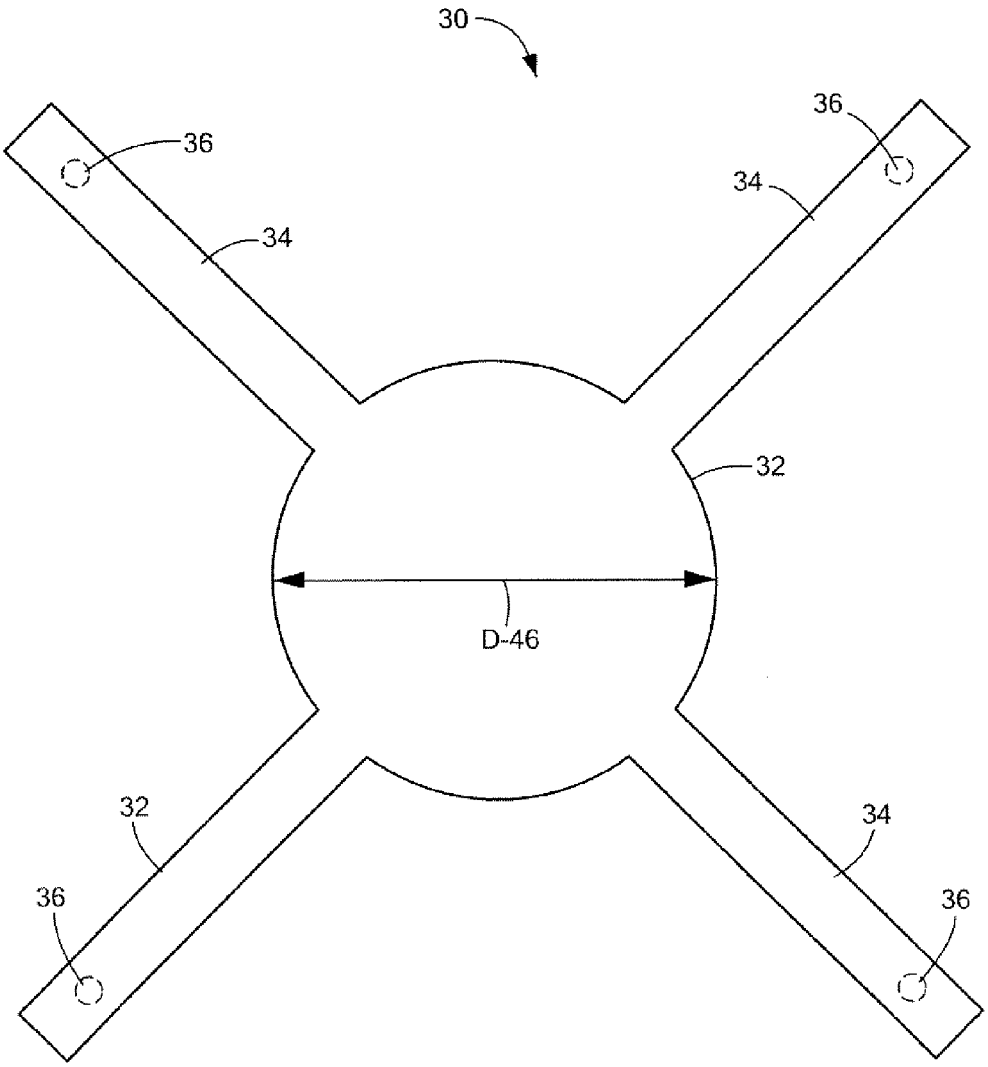
FIG. 2 is a schematic top-view of one embodiment of the core form device of this invention.

There is shown in FIG. 2, one embodiment of core form device 30 of this invention. Device 30 includes circular plate 32 and a plurality of bendable arms 34 extending from plate 32 as shown. In this example, core form device includes four arms 34 extending from plate 32 for use with a typical core hole having a diameter in the range of about 2 inches to about 20+ inches. Preferably, arms 34 each include orifice or opening 36 for receiving a concrete fastener. In another design, one or more of arms 34 may not necessarily include opening 36. In this design, a hole may be drilled in one or more of arms 34 as needed.

Circular plate 32 may be manufactured in various diameters to accommodate core holes of various sizes. In one example, diameter d-46 of circular plate 32 is in the range of about 2 inches to about 12 inches. In one preferred design, diameter d-40 of circular plate is about 3¼ inches, e.g., about ¼ inch less than the size of a typical core hole for easy installation. In another example, diameter d-40 of circular plate 32 may be only about ⅛ inch less than the diameter of the core hole for easy installation.

Figure 3A:
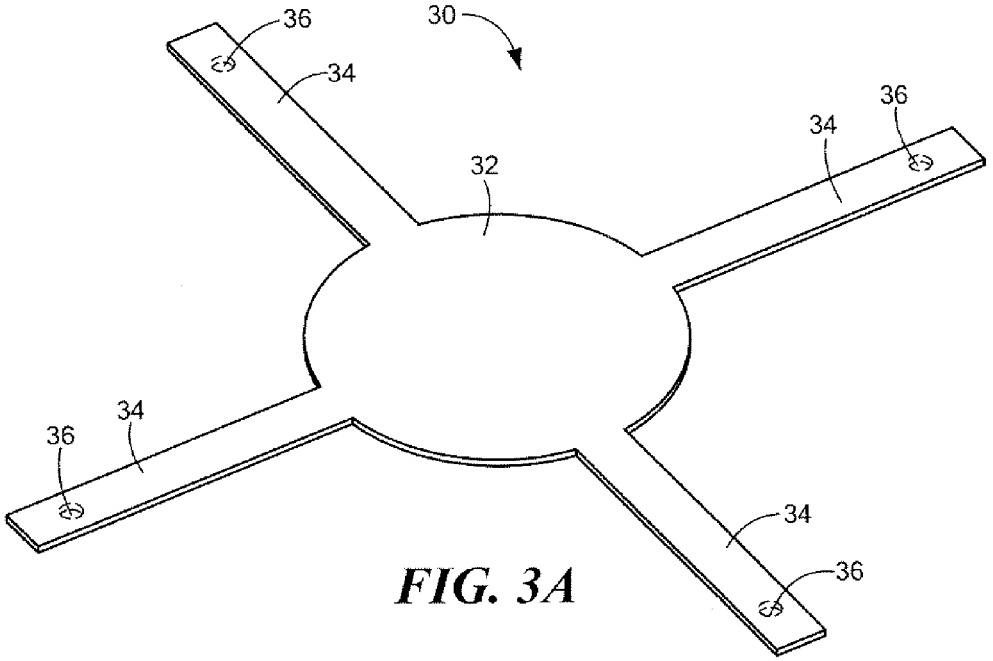
FIGS. 3A-3B are three-dimensional views showing an example of the arms being bent about the circular plate of the core form device shown in FIG. 1.
Figure 3B:
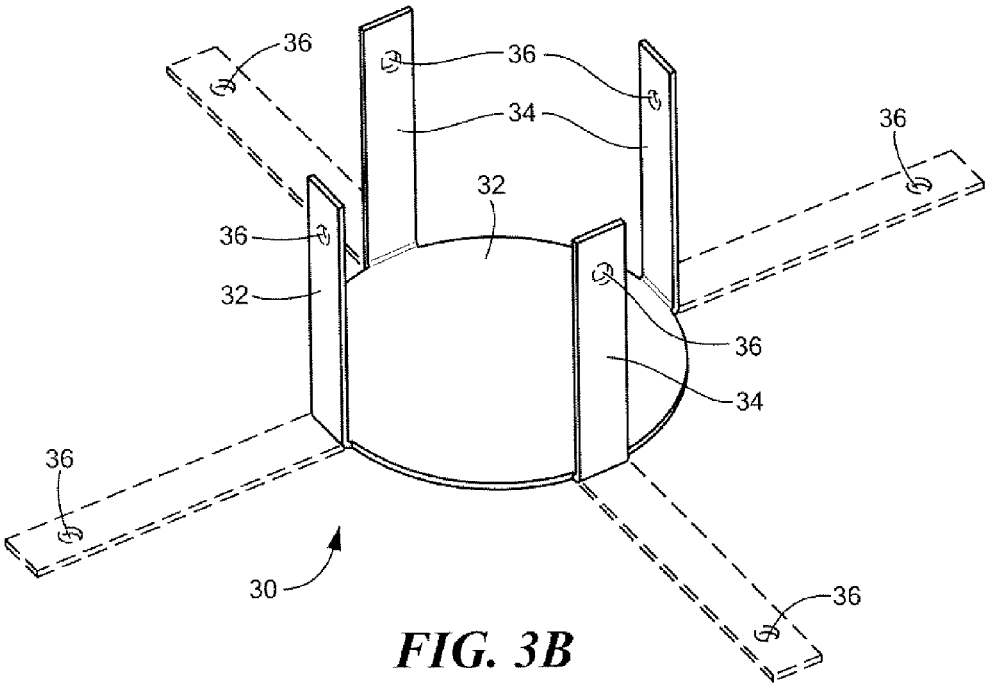
Figure 4:
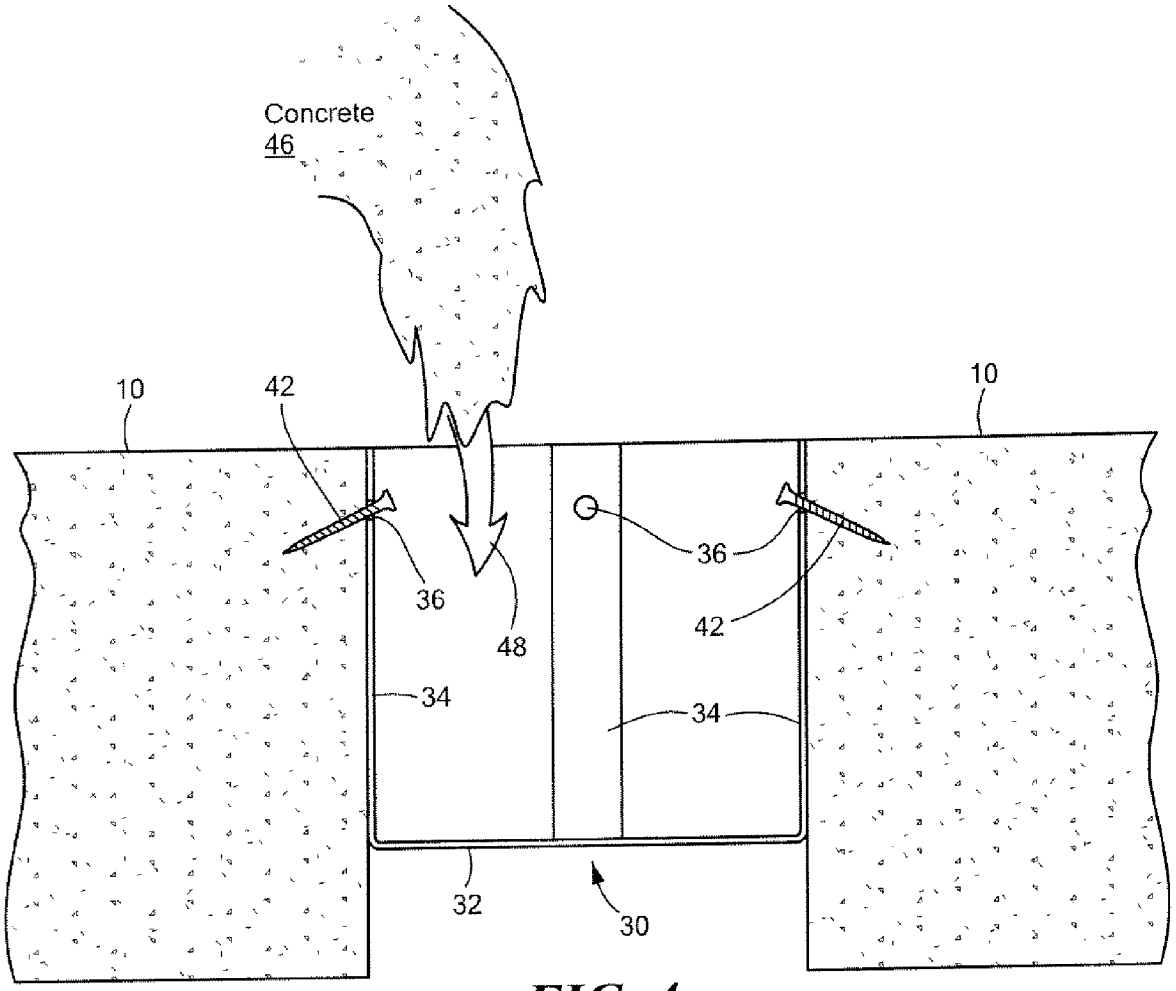
FIG. 4 is a schematic side-view showing the core form device shown in FIGS. 2-3 used to repair a core hole.

Arms 34 of core form device 30, FIGS. 2 and 3A, where like parts have been given like numbers, are bent as shown in FIG. 3B to form core form 40 which fits inside a core hole, e.g., core hole 12, FIG. 4, having a diameter of about 3½ inches. In one example, when the walls of the core hole are straight, arms 34, FIG. 3B, are bent about 90° as shown. In other examples, arms 34 may be bent at a slight angle to accommodate core holes with slanted walls. Core form 40 is then inserted into core hole in a concrete slab or floor, e.g., core hole 12, FIG. 4, as shown. Fasteners 42, e.g., concrete fasteners, may then be driven through openings 36 in one or more of arms 34 through arms 34 or holes may be drilled into arms 34 which do not have an opening therein. Core form 44 is then filled with concrete 46, indicated by arrow 48 to efficiently fill core hole 12.

Figure 5:
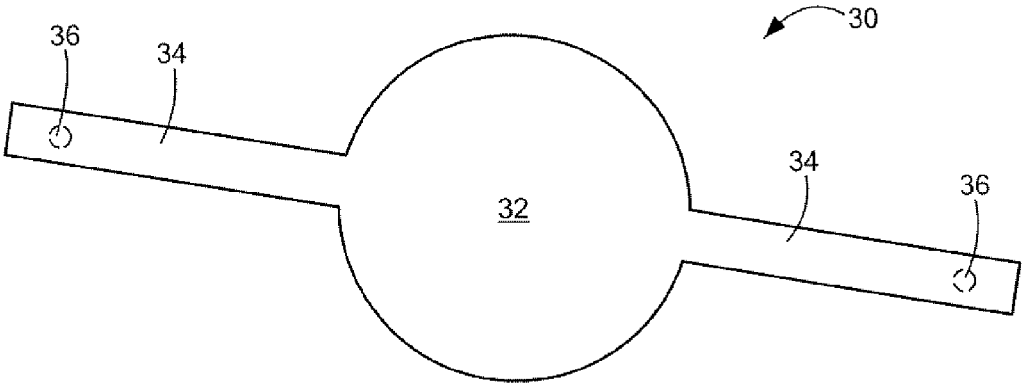
FIG. 5 is a schematic top-view of another embodiment of the core form device of this invention including two arms extending from the circular plate.
Figure 6:
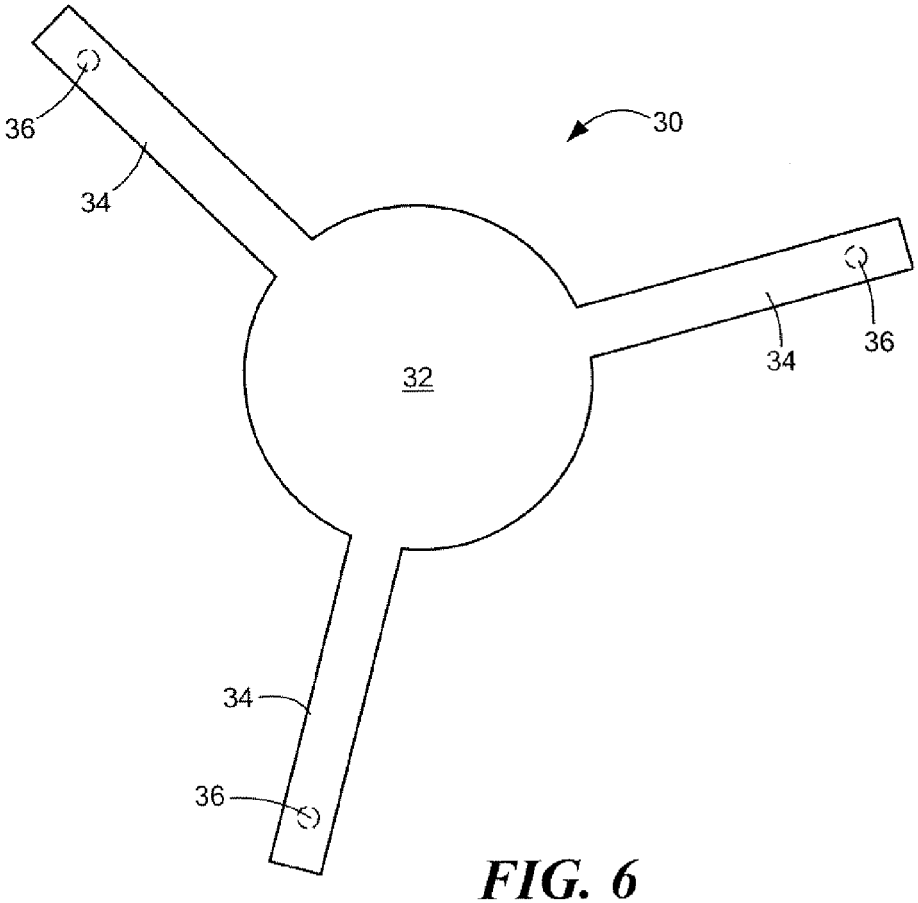
FIG. 6 is a schematic top-view of another embodiment of the core form device of this invention including three arms extending from the circular plate.
Figure 7:
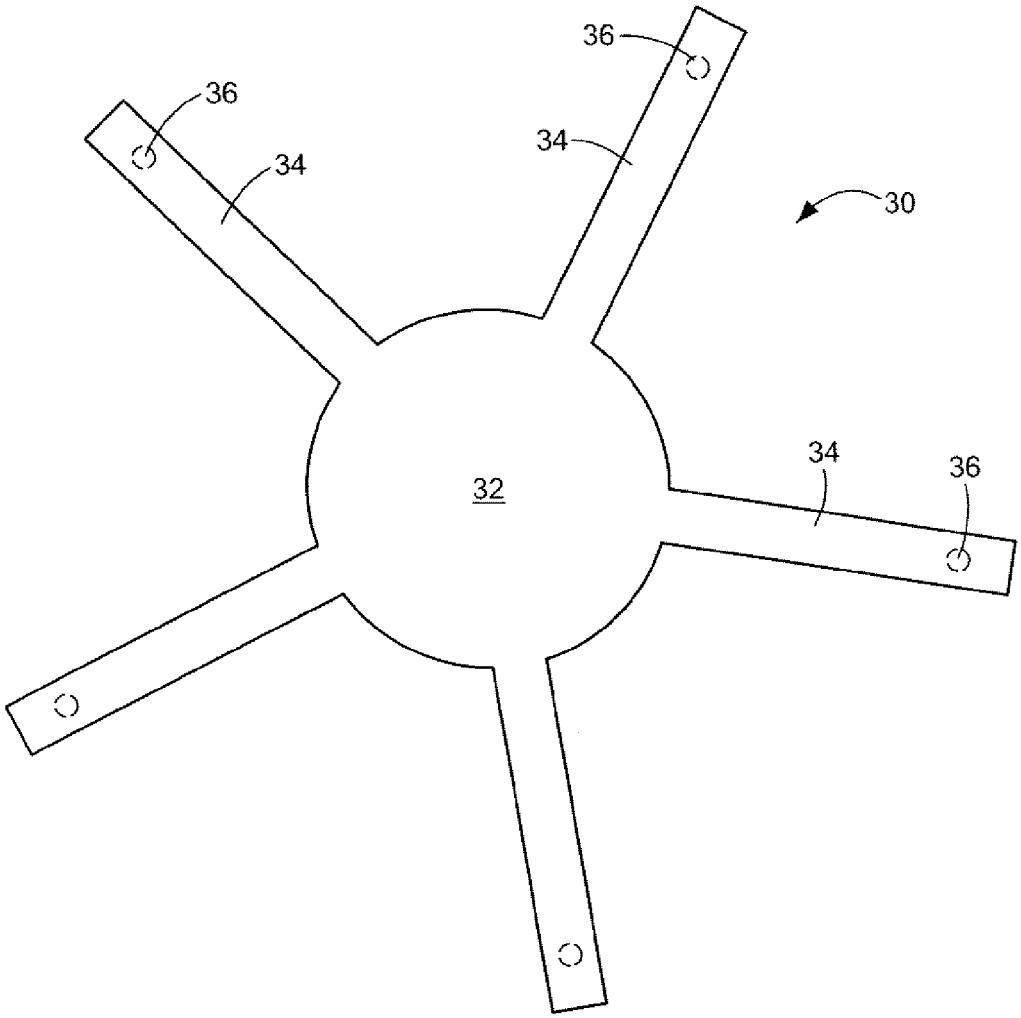
FIG. 7 is a schematic top-view of yet another embodiment of the core form device of this invention including five arms extending from the circular plate.
Figure 8:
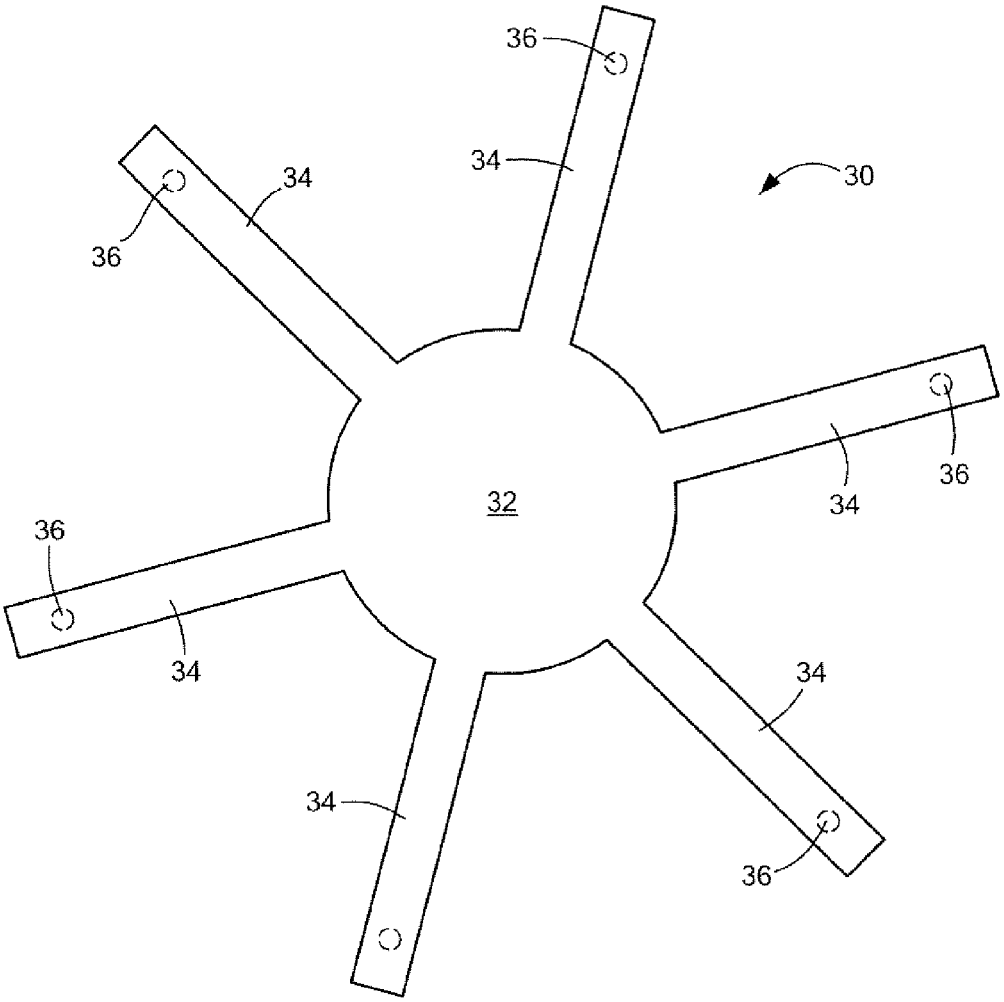
FIG. 8 is a schematic top-view of another embodiment of the core form device of this invention including six arms extending from the circular plate.

For smaller core holes, e.g., core holes having a diameter of about 2 inches, core form device 30, FIGS. 2-4, may only include two arms 34, e.g., as shown in FIG. 5 or three arms extending from circular plate 32, e.g., as shown in FIG. 6. For larger core holes, e.g., core holes having a diameter greater than about 10 inches, core form device 30, FIG. 7, may include five bendable arms 34 extending from circular plate 32 or six bendable arms 34 extending from circular plate 32 as shown in FIG. 8. In other examples, core form device may include more than six arms depending on the size of the core hole, e.g., seven, eight, or more bendable arms 34 extending from circular plate 32, as known by those skilled in the art.

In one example, core form device 30 may be made of 16-20 gauge sheet metal, strong plastic material, or similar type material. In other examples, core form device 30 may be made of an alloy material.

In one example, the length of arms 34 is in the range of 2 inches to about 12 inches, e.g., about 4 inches to about 5 inches which is the standard thickness of a typical concrete floor or slab. Preferably, holes 36 in one or more of arms 34 are between $\frac{1}{8}^{th}$ of an inch and $\frac{3}{16}^{th}$ of an inch in diameter to allow for the use of standard concrete anchors to be utilized.

The result is core form device 30 effectively and efficiently fills core holes, e.g., core hole 12, FIG. 4, without the need to utilize plates 16 or 18, FIG. 1, on bottom surface 20 of concrete floor 10. Therefore no entry is required to the floor space below floor 12. Thus, core form device 30, FIG. 1, can save significant expense during a renovation project.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A core form device comprising:

a core form having a completely solid circular plate and a plurality of discrete bendable arms extending therefrom;

wherein the bendable arms are positioned around and extending from a perimeter edge of the solid circular plate, the bendable arms remain bent in a bent configuration to form the core form, and at least one said bendable arm includes an aperture for receiving a fastener that permanently secures the core form in a core hole;

wherein the core form is a unitary structure of one-piece construction composed of a single piece of material; and wherein the core form is configured to be inserted into the core hole of a concrete structure.

2. The core form device of claim 1 in which the solid circular plate and the bendable arms are made of a metal material.

3. The core form device of claim 1 in which the solid circular plate and the bendable arms are made of an alloy material.

4. The core form device of claim 1 in which the solid circular plate and the bendable arms are made of plastic.

5. The core form device of claim 1 in which the plurality of arms includes six arms.

6. The core form device of claim 1 in which the plurality of arms includes five arms.

7. The core form device of claim 1 in which the plurality of arms includes four arms.

8. The core form device of claim 1 in which the plurality of arms includes three arms.

9. The core form device of claim 1 in which the plurality of arms includes two arms.

10. The core form device of claim 1 wherein the concrete structure is a concrete slab.

11. The core form device of claim 10 in which the concrete slab includes a concrete floor.

12. The core form device of claim 10 in which a diameter of the solid circular plate is less than a diameter of the core hole.

13. A method for manufacturing a core form device, the method comprising:

providing the core form device of claim 1; and bending the bendable arms about the perimeter edge of the solid circular plate to form the core form for filling core holes in the concrete structure.

14. The method of claim 13 in which the solid circular plate has a diameter less than a diameter of the core hole.

15. A method for filling a core hole in a concrete slab, the method comprising:

providing a one-piece solid circular plate including a plurality of bendable arms extending from the solid circular plate;

bending the bendable arms about the solid circular plate such that the bendable arms remain bent to form a core form for filling the core hole in the concrete slab;

inserting the core form into the core hole in the concrete slab;

permanently attaching one or more of the bendable arms to the concrete slab; and pouring concrete into the core form to repair the core hole.

16. The method of claim 15 in which the concrete slab includes a concrete floor.

17. The method of claim 15 in which providing the solid circular plate includes providing the solid circular plate with a diameter less than the diameter of the core hole.

18. The method of claim 17 further including providing an opening in one or more of the bendable arms for receiving a fastener.

* * * * *